US009643695B1

(12) United States Patent
Breaux et al.

(10) Patent No.: US 9,643,695 B1
(45) Date of Patent: May 9, 2017

(54) REMOVABLE SUCTION CUP FIN

(71) Applicants: David Michael Breaux, Kensington, CA (US); Rohan John Irvin, Bellaire, TX (US)

(72) Inventors: David Michael Breaux, Kensington, CA (US); Rohan John Irvin, Bellaire, TX (US)

( * ) Notice: Subject to any disclaimer, the term of this patent is extended or adjusted under 35 U.S.C. 154(b) by 0 days.

(21) Appl. No.: 15/349,210

(22) Filed: Nov. 11, 2016

(51) Int. Cl.
*B63B 35/79* (2006.01)
*B63B 35/71* (2006.01)

(52) U.S. Cl.
CPC .... *B63B 35/7926* (2013.01); *B63B 2035/715* (2013.01)

(58) Field of Classification Search
CPC ..... B63B 35/7926
USPC ..... 441/74, 79
See application file for complete search history.

(56) References Cited

U.S. PATENT DOCUMENTS 3,747,138 A 7/1973 Morgan
3,810,268 A 5/1974 Weihe
4,325,154 A 4/1982 Collum, Jr.
4,328,761 A * 5/1982 Dwyer ..... B63B 59/08 114/222
4,421,492 A 12/1983 Leva
4,701,144 A 10/1987 DeWitt, III
4,846,429 A * 7/1989 Scheurer ..... F16B 47/00 248/205.8
5,176,553 A 1/1993 Tuttle
5,715,876 A * 2/1998 Burt ..... B63B 25/082 114/343
6,139,383 A * 10/2000 Jolly ..... B63B 35/793 114/39.15
6,154,929 A * 12/2000 Dwyer ..... B63B 17/00 16/422
6,244,778 B1 * 6/2001 Chesbrough ..... A47G 1/17 248/205.6
6,752,674 B2 6/2004 Jolly
7,108,571 B2 * 9/2006 Geraghty ..... B63B 35/793 114/39.15
7,144,285 B1 12/2006 Hendricks
7,216,600 B1 * 5/2007 Hamilton ..... B63B 35/81 114/242
8,246,406 B2 8/2012 Field
8,944,872 B2 * 2/2015 Hill ..... B63B 35/7923 114/288
9,085,343 B2 7/2015 Modica
(Continued)

FOREIGN PATENT DOCUMENTS

EP 1044874 A2 10/2000

*Primary Examiner* — Lars A Olson
*Assistant Examiner* — Jovon Hayes
(74) *Attorney, Agent, or Firm* — David Breaux

(57) ABSTRACT

A removable fin assembly with at least one suction cup for attaching to a small watercraft and a method for attaching a fin assembly using at least one suction cup to a small watercraft. The fin assembly removably attaches to the underside of a small watercraft with the fin extending downwardly. The fin assembly is made up of at least one suction cup, at least one distributor to spread out the forces across the suction cup or cups, and at least one fin. The fin can be a traditional fin, a hydrofoil keel, or something similar. An optional shell can be added around the attachment location to reduce drag. Recesses can be added to the distributor to help support the fin or reduce drag.

15 Claims, 10 Drawing Sheets

(56) References Cited

U.S. PATENT DOCUMENTS

| | | | | |
|---|---|---|---|---|
| 9,296,447 | B1 * | 3/2016 | Morgan | B63B 1/28 |
| 9,422,028 | B2 * | 8/2016 | Wilhelm | B63B 1/32 |
| 9,457,877 | B2 * | 10/2016 | Chung | B63B 35/7926 |
| 2003/0092333 | A1 | 5/2003 | McCausland et al. | |
| 2007/0173145 | A1 * | 7/2007 | Koelling | B63B 35/7909 441/74 |
| 2007/0202760 | A1 | 8/2007 | Caldwell | |
| 2009/0253319 | A1 * | 10/2009 | Ferru | B63B 35/793 441/79 |
| 2015/0076194 | A1 * | 3/2015 | Sidwa | B63B 35/7946 224/259 |
| 2015/0225040 | A1 | 8/2015 | Geislinger | |
| 2015/0360751 | A1 * | 12/2015 | Hanscom | B63B 35/7933 114/364 |
| 2016/0144933 | A1 * | 5/2016 | Kumano | B63B 35/793 441/79 |

* cited by examiner

REMOVABLE SUCTION CUP FIN

TECHNICAL FIELD

The apparatus described relates to small watercraft such as surfboards, standup paddle boards, wakeboards, kiteboards, kayaks, jet skis, and the like. In particular, it relates to a method and apparatus for removably attaching at least one fin to a small watercraft.

BACKGROUND OF THE INVENTION

Small watercraft often rely on a fin or a plurality of fins to provide horizontal lift or thrust to aid in tracking, steering, and stabilization of the watercraft. Some classes of fins also provide vertical lift to the watercraft.

A hydrofoil would be one example of a complex fin which provides vertical lift. Hydrofoils come in many shapes and designs but a common design for a hydrofoil intended for small watercraft comprises a keel attached to an optional longitudinal body and attached to at least one wing. Many different designs for hydrofoil wings and bodies exist but a keel is a commonality across many of these designs and is referred to as a hydrofoil keel.

Fins can be designed to be removable or non-removable from the watercraft.

Fins attached by a non-removable means cannot be interchanged between watercraft and the fin cannot be easily removed to aid in storage and transport of the watercraft. If damaged, non-removable fins can be expensive to repair since they are incorporated into the watercraft. Non-removable attachment could include attachment by molding or gluing the parts together.

Removable fins are common in watercraft such as surfboards and kiteboards, but these removable fins generally require the watercraft to be designed to incorporate the fin by means of a non-removable fin receptacle. Non-removable fin receptacles such as fin boxes, bolt holes, threaded holes, cavities, recesses, slots and the like are generally designed into the watercraft. These non-removable fin receptacles can limit the placement of fins on the watercraft and can limit the types of fins that are used.

It is common for water enthusiasts to own multiple watercraft. Users have long desired for there to be an easy method and apparatus to attach a removable fin to a watercraft and swap that same fin between watercraft even if the watercraft was not originally designed with the matching fin receptacle. For example, a surfer who already owns a surfboard without a hydrofoil keel receptacle cannot easily or non-destructively attach a hydrofoil keel to their existing surfboard. Likewise an inflatable standup paddle board owner cannot easily add a removable fin to their inflatable, board if' the fin receptacle was not designed into the original board.

There are essentially four "groups" of related art that should be discussed in detail.

Group one depicts removable fins which rely on non-removable fin receptacles. Related art U.S. Pat. No. 8,246,406 to John Field depicts such an assembly. John Field's removable fin mates with a non-removable fin receptacle described as a "fin box". Typically these fin boxes are incorporated into the watercraft and the fin box is not easily removable or easily adjustable. Also in this group is related art U.S. Pat. No. 7,108,571 B2 to Dean Geraghty. Dean Geraghty depicts a removable fin box which fits inside a recess or cavity on the watercraft. While Dean Geraghty's fin box is removable it shares similar limitations to non-removable fin boxes due to the use of a recess which is incorporated into the watercraft. The recess or cavity is effectively a non-removable receptacle. The location of the recess or cavity is not easily adjusted after the watercraft is manufactured.

Group two depicts fin box adapters. In this group, adapters are designed to allow removable fins to be used in more than one style of non-removable fin receptacles. Related art U.S. Pat. No. 5,176,553 to Lawrence Tuttle depicts such an assembly. Lawrence Tuttle's assembly allows a fin designed for a narrow and shallow fin receptacle to be used on a watercraft that has a wider and deeper fin receptacle. While Tuttle's assembly allows for a removable fin to be used on watercraft with different fin receptacles, it requires the watercraft to have a non-removable receptacle to mate with the receptacle. Similar to group one, the non-removable receptacle is incorporated into the watercraft.

Group three depicts adjustable fins. Related art U.S. Pat. No. 4,421,492 to Donn Leva depicts such an assembly. Donn Leva describes a non-removable fin receptacle which is essentially a slot incorporated into the watercraft. The fin attaches to the slot which allows the fin to slide forwards and backwards. While this slot allows for more adjustment than a standard fin box, the watercraft still incorporates a non-removable fin receptacle in the form of a slot which suffers from many of the same drawbacks described previously.

Group four depicts breakaway fins. Related U.S. Pat. No. 4,701,144 to Glen DeWitt depicts such an assembly. Glen Dewitt's fin incorporates a breakaway tab that allows the tin to separate from the watercraft in the event excessive force is exerted. This assembly incorporates a non-removable fin receptacle which suffers from many of the limitations of group one. Additionally, in this specific example, the retaining tab has to be replaced when the fin separates so the fin does not separate non-destructively.

Technical Problem

One problem with the related art described is that incorporating a fin or a fin receptacle into the body of the watercraft often requires additional manufacturing steps and can increase the cost of the watercraft. A second problem is that removable fins which attach to non-removable fin receptacles are typically not easily interchangeable between watercraft unless the different watercraft share receptacles that are designed to accept the same removable fin or if a fin adapter is used. Fin adapters are not universal and are often limited in the types of fins they can accommodate. A third problem is that fins, especially long fins like hydrofoil keels, are prone to striking objects in or beneath the water. The force exerted by a fin striking an object or even striking the surface of the water can damage the watercraft especially when the fin is firmly anchored to the watercraft. This potential damage mechanism can require additional reinforcement of the fin and the watercraft which can cost more during design and construction. A fourth problem is that if a removable fin separates from the watercraft while the watercraft is on the water, it can be difficult to quickly re-attach the fin. It is especially difficult to re-attach fins in sports like kitesurfing in which the user often has to use one hand to control their kite and only has one hand free for other tasks like re-attaching a fin to a watercraft. A fifth problem is that the placement of removable fins on a watercraft is often restricted by the location of the non-removable fin receptacle which can limit fine tuning of fin placement.

BRIEF SUMMARY OF THE INVENTION

The present invention addresses the problems above by providing a method and apparatus to easily attach and remove at least one fin and to swap the same fin assembly across many different types of watercraft even if the watercraft were not originally designed with a fin receptacle. The method and apparatus described allows the fin to break away from the watercraft in a non-destructive manner when the fin experiences excessive force, preventing damage to the fin and to the watercraft. The method and apparatus described allows a fin to be easily reattached to a watercraft in the event of separation without the need to replace parts. Additionally, because the fin attachment point is not limited to a non-removable fin receptacle, fin placement can be less restricted allowing the user to fine tune fin placement to their own preferences. The present invention is especially useful in attaching newer style fins including hydrofoil keels and the like to older style watercraft like traditional surfboards, kayaks, and the like which do not have receptacles for the newer style fins. This can save the user money because they can avoid buying a new board. The present invention is also especially useful for attaching removable fins to inflatable watercraft including inflatable rafts, inflatable stand up paddleboards and the like. The uses of the fin receptacle are not limited to the examples above.

A primary object of the present invention is to provide a removable fin assembly which overcomes the shortcomings of the related art.

A further object of the invention is to provide a removable fin assembly which can break away non-destructively when the fin experiences excessive force.

Another object of the invention is to provide a removable fin assembly which allows the user to fine tune fin placement on a watercraft.

Another object of the invention is to minimize drag associated with the removable fin assembly.

Another object of the invention is to make the fin assembly easy to retrieve when detached.

Further objects of the invention will appear as the description proceeds. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
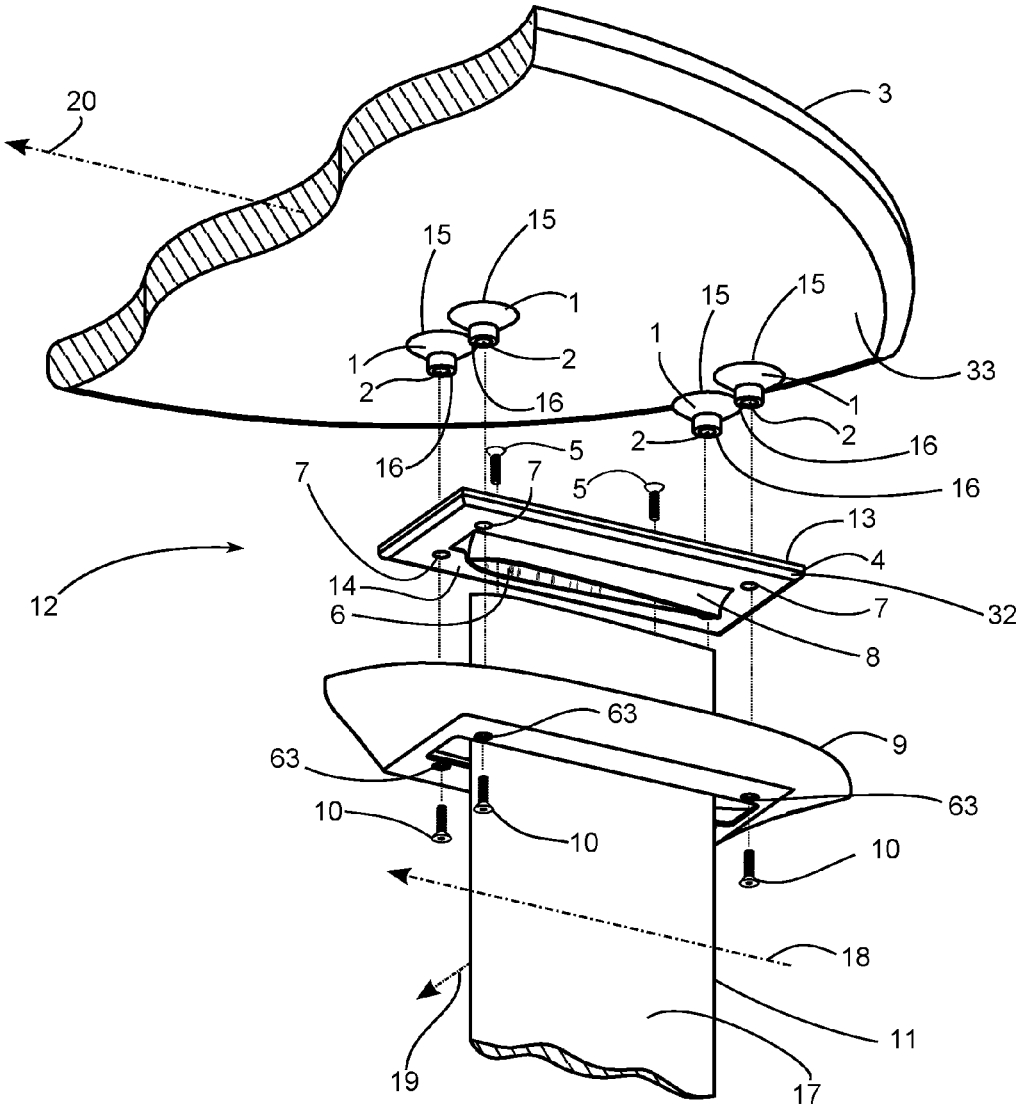
FIG. 1 is an exploded perspective view of the preferred embodiment of the fin assembly with portions of the fin and watercraft broken away and configured with a long keel, similar to what would be found in a hydrofoil, and configured with an optional shell.

In the following detailed description, numerous specific details are set forth in order to provide a thorough understanding of the embodiments of the present invention. It will be understood by those of ordinary skill in the art that these embodiments of the present invention may be practiced without some of these specific details. In other instances, well-known methods, procedures, components and structures may not have been described in detail so as not to obscure the embodiments of the present invention.

Prior to explaining at least one embodiment of the present invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein are for the purpose of description and should not be regarded as limiting.

It is appreciated that certain features of the invention, which sue, for clarity, described in the context of separate embodiments, may also be provided in combination in a single embodiment. Conversely, various features of the invention, which are, for brevity, described in the context of a single embodiment, may also be provided separately or in any suitable sub-combination.

The preferred embodiment of the fin assembly 12 is illustrated in FIG. 1 in an exploded perspective view. The fin member 11 and the watercraft 3 are broken away for illustration purposes. The watercraft 3 has a centerline 20. The fin member 11 is attached to the fin side 14 of the distributor member 4 with screws 5 and further supported by an optional recess 6 in the raised face 8 of the distributor member 4. The fin member 11 has a longitudinal axis 18 and a transverse axis 19 and the port side 17 is visible. The fin member 11 is shown as a keel type fin similar to what would be found in a typical hydrofoil keel. The distributor member 4 is configured with optional filleted edges 32. The suction side 13 of the distributor member 4 is attached to the anti-cup side 16 of four suction cups 1 with screws 10 through tapped holes 2 in the suction cups 1, untapped holes 7 in the distributor member 4, and untapped holes 63 in the optional shell 9. The optional shell 9 has walls bending upwardly from the perimeter of the distributor member 4. The optional shell 9 is attached to the fin side 14 of the distributor member 4 with screws 10. The cup sides 15 of the suction cups 1 are attached to the underside 33 of the watercraft 3 with suction force created by the suction cup. It will be understood by those of ordinary skill in the art that other standard attachment means could be used in place of the screwed attachments illustrated, it will be understood by those of ordinary skill in the art that a keel could further attach to various configurations of hydrofoil wings. In general, the distributor member 4 distributes the forces generated by the fin across the suction cups 1 but can serve other functions as well.

Figure 2:
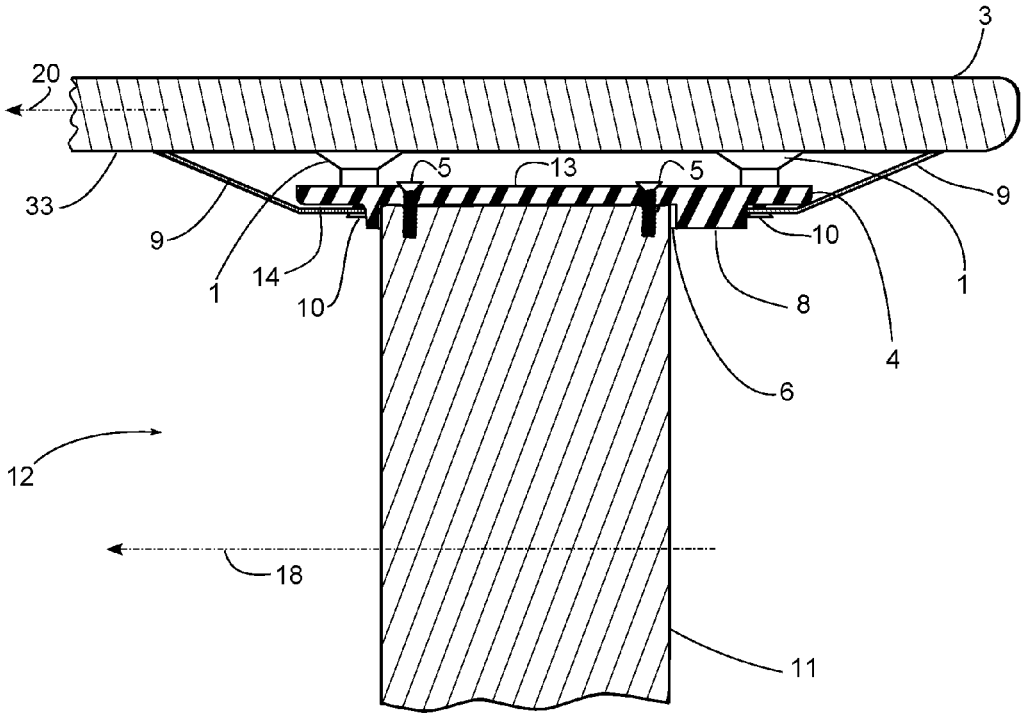
FIG. 2 is cross-section side view of the preferred embodiment of the fin assembly where the cross section is taken through the centerline of the watercraft.

The preferred embodiment of the fin assembly 12 is further illustrated in FIG. 2 in a non-exploded cross sectional side view where the cross section is taken through the centerline of the watercraft 3. The watercraft 3 and the fin member 11 are broken away for illustration purposes. This view further illustrates the optional shell 9 bending upwardly and terminating as close as possible to the underside 33 of the watercraft 3.

Figure 3:
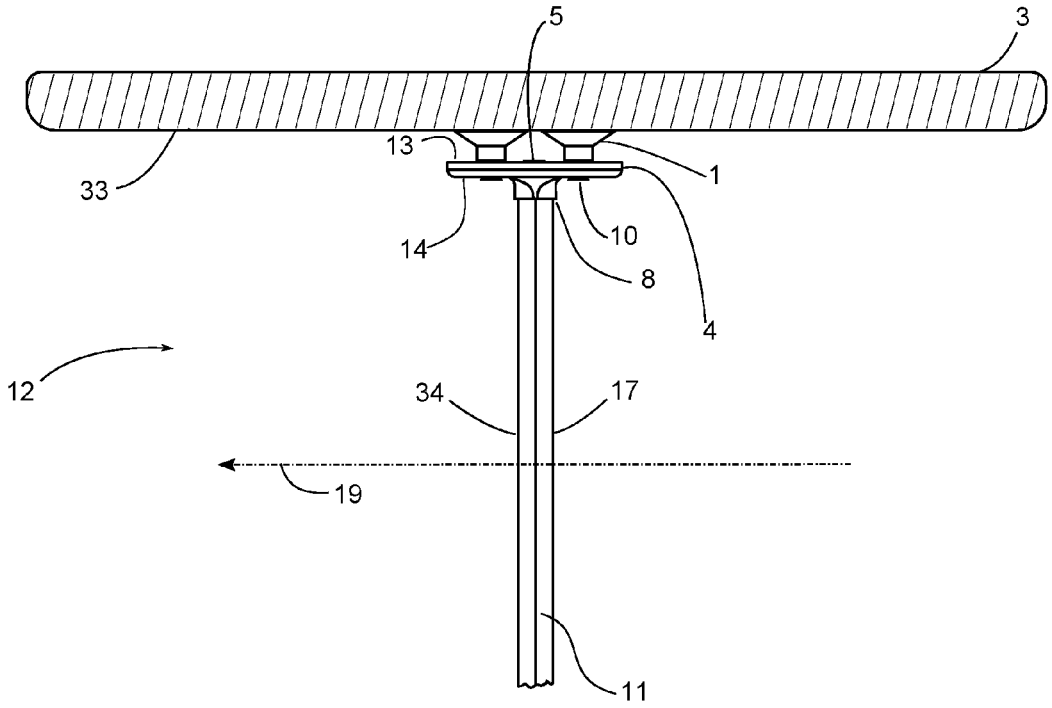
FIG. 3 is a front view of the assembled preferred embodiment configured without the optional shell.

The preferred embodiment of the fin assembly 12 is further illustrated in FIG. 3 in a non-exploded front view configured without shell 9 of FIG. 1 and FIG. 2. FIG. 3 shows the watercraft 3 and fin member 11 broken away for illustration purposes. This view further illustrates the transverse axis 19 of the fin member 11 which runs between the port side 17 and the starboard side 34.

Figure 4:
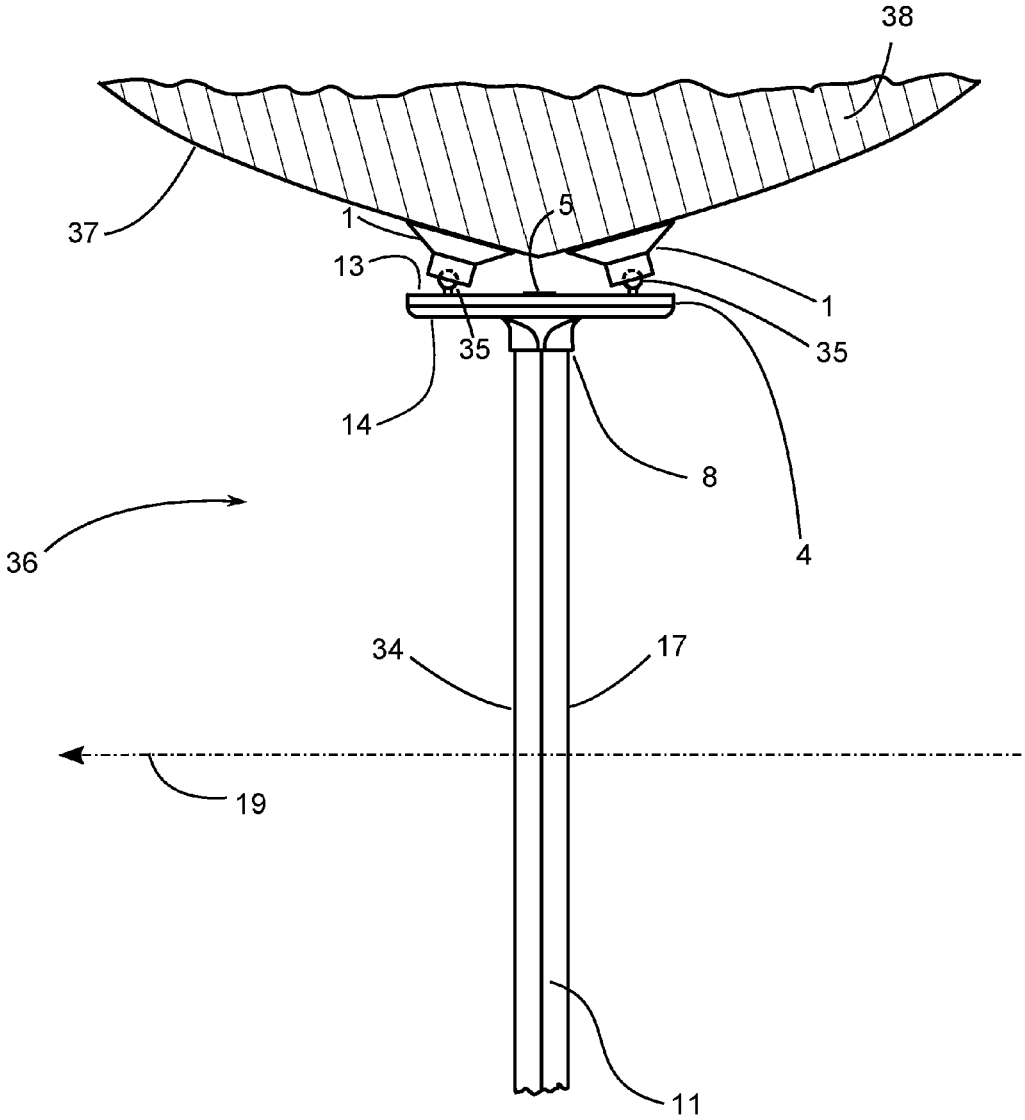
FIG. 4 is a front view of an alternative embodiment of the fin assembly configured with suction cups having adjustable connections to the distributor member and without a shell and where the suction cups are connected to a watercraft having a curved exterior.

An alternative embodiment of the fin assembly 36 is illustrated in FIG. 4 in a non-exploded front view. This embodiment shares many of the components of the preferred embodiment with the primary change being that the screws 10 of FIG. 3 have been substituted for ball joints 35 to demonstrate attaching the alternative embodiment of the fin assembly 36 to the curved underside 37 of a watercraft 38. FIG. 4 shows the suction cups 1 attached to the suction side 13 of the distributor member 4 with a ball joint 35. It will be understood by those of ordinary skill in the art that other standard movable attachment means could be used in place of the ball joint illustrated.

Figure 5:
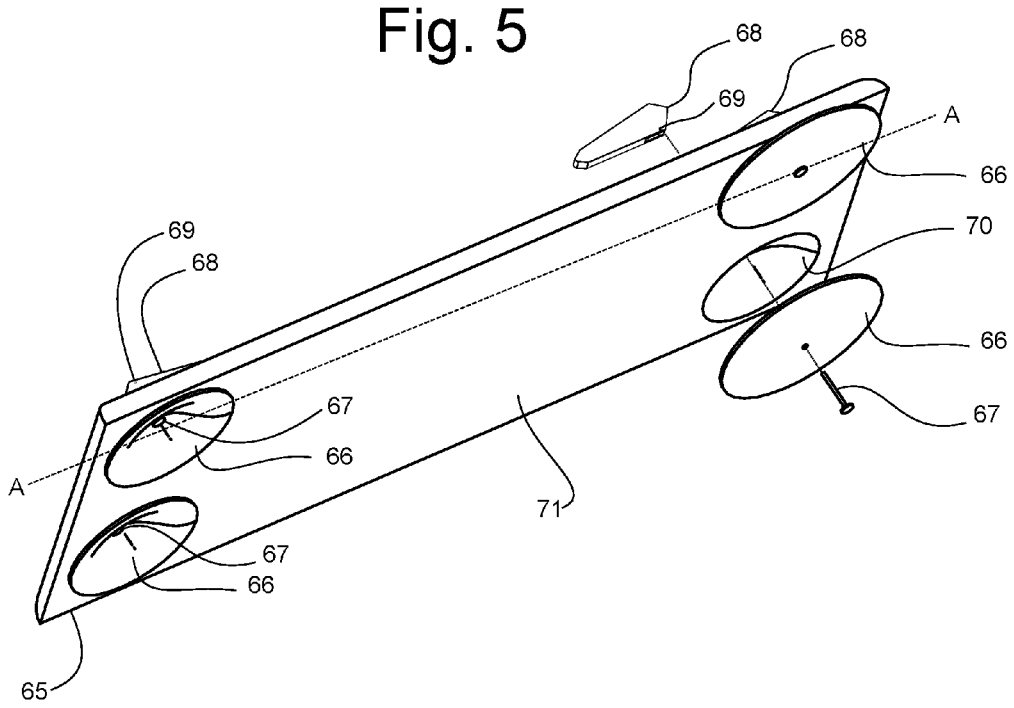
FIG. 5 is a perspective view of an alternative embodiment of the distributor member configured with lever activated suction cups and without a shell.
Figure 6:
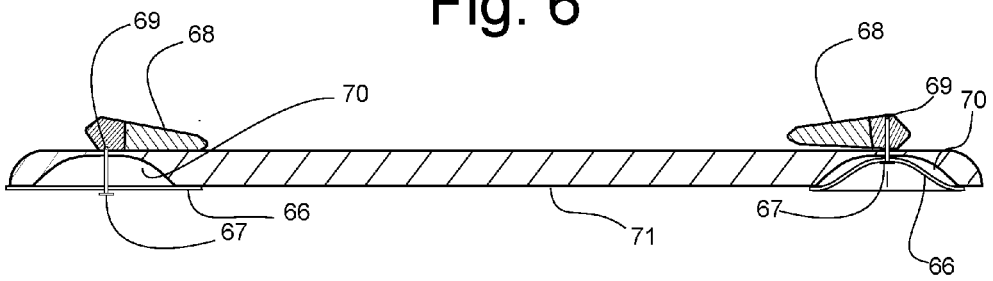
FIG. 6 is a cross sectional view of the alternative embodiment of the distributor member of FIG. 5.

An alternative embodiment of the distributor member 65 is illustrated in FIG. 5 in a partially exploded perspective view without a fin member attached. In this embodiment, the suction cups 66 are lever activated where the suction cup 66 is attached to a shaft member 67 which is attached to a lever member 68 with a small pin or hinge 69. Each lever activated suction cup is set in a recess 70 on the suction side 71 of the distributor member 65. When activated the lever member 68 pulls the shaft member 67 and the suction cup 66 into the recess creating a suction force. FIG. 6 is a cross sectional side view taken along line A-A of FIG. 5. FIG. 6 further illustrates the alternative embodiment of the distributor member 65. FIG. 6 shows both an activated and a non-activated suction cup 66.

Figure 7:
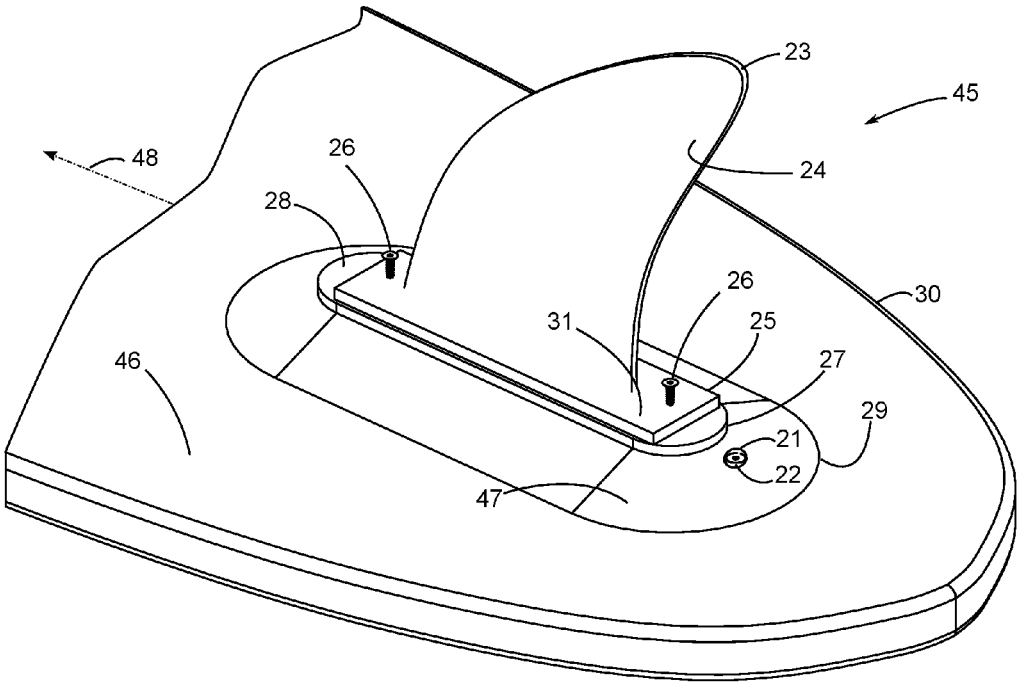
FIG. 7 is a bottom perspective view of an alternative embodiment of the fin assembly configured with an elongated suction cup, a vent port, a backflow prevention device, a traditional tin, and without a shell.

A different embodiment of the fin assembly 45 is illustrated in FIG. 7 in a non-exploded bottom oriented perspective view with the underside 46 of the watercraft 30 facing up. In this embodiment, a singular elongated suction cup 27 contains a vent port 21. A backflow prevention device 22 is mounted inside the vent port 21. The backflow prevention device 22 is oriented such that fluid flow through the backflow prevention device 22 can flow from the interior wall 49 of FIG. 8 to the exterior wall 50 but fluid flow is limited in the reverse direction. The exterior wall 47 of the elongated suction cup 27 is visible. The cup side 29 of the elongated suction cup 27 is attached to the underside 46 of the watercraft 30 with suction force. The anti-cup side 28 of the elongated suction cup 27 is attached to the distributor member 25 with screws 26. The screws are shown in a loosened state for illustrative purposes. It will be understood by those of ordinary skill in the art that other standard attachment means could be used in lieu of the screwed attachments illustrated. It will also be understood by those of ordinary skill in the art that the backflow prevention device could be selected from a number of common designs such as diaphragm check valves, flapper check valves, and the like. In this embodiment, the fin member 23 is non-removably attached to the fin side 31 of the distributor member 25. The fin member 23 is illustrated as a traditional surf fin. The starboard side 24 of the fin member 23 is visible. The watercraft 30 has a centerline 48. The fin assembly 45 is shown centered on the board for illustrative purposes. It will be understood that the suction mechanism could allow the user to place the fin assembly off center if desired.

Figure 8:
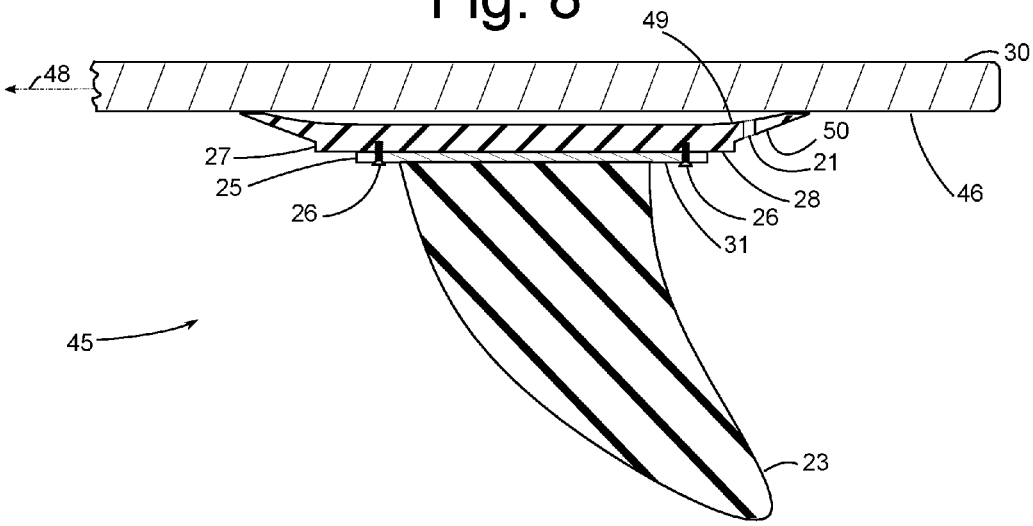
FIG. 8 is a cross-section side view of an alternative embodiment of the fin assembly where the cross section is taken through the centerline of the watercraft in FIG. 7.

The embodiment of the fin assembly 45 of FIG. 7 is further illustrated in FIG. 8 in a non-exploded cross-sectional side view where the cross section is taken down the centerline 48 of the watercraft 30 of FIG. 8 and the underside 46 of the watercraft 30 is facing down. In FIG. 8 the interior wall 49 and the exterior wall 50 of the elongated suction cup 27 are shown. The vent port 21 is shown to tunnel from the exterior wall 50 to the interior wall 49. The backflow prevention device 22 of FIG. 7 is excluded from the vent port in this view for illustrative purposes. The screws 26 are shown in their fastened state.

Figure 9:
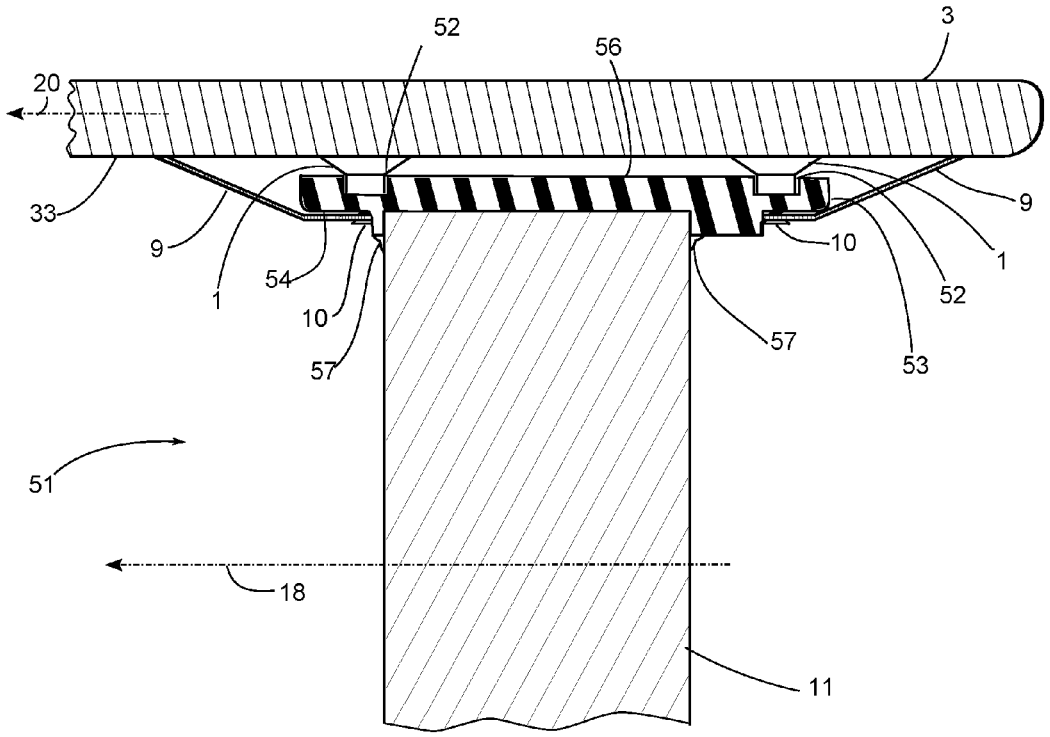
FIG. 9 is a cross-section side view of an alternative embodiment of the distributor member configured with recesses on the suction side of the distributor member.

Another embodiment of the fin assembly 51 is illustrated in FIG. 9 in a cross sectional side view similar to FIG. 2. This embodiment shares many features with the preferred embodiment such as the shell 9 suction cups 1, screws 10, watercraft 3, centerline 20, longitudinal axis 18, and fin member 11. In this embodiment, the fin member 11 is non-removably attached by means of a weld 57 to the fin side 54 of the distributor member 53. It will be understood by those of ordinary skill in the art that other non-removable attachment means could be used in place of a weld. The suction cups 1 mate with the distributor member 53 at recesses 52 which are located on the suction side 56 of the distributor member 53 and the suction cups 1 are attached by screws 10.

Figure 10:
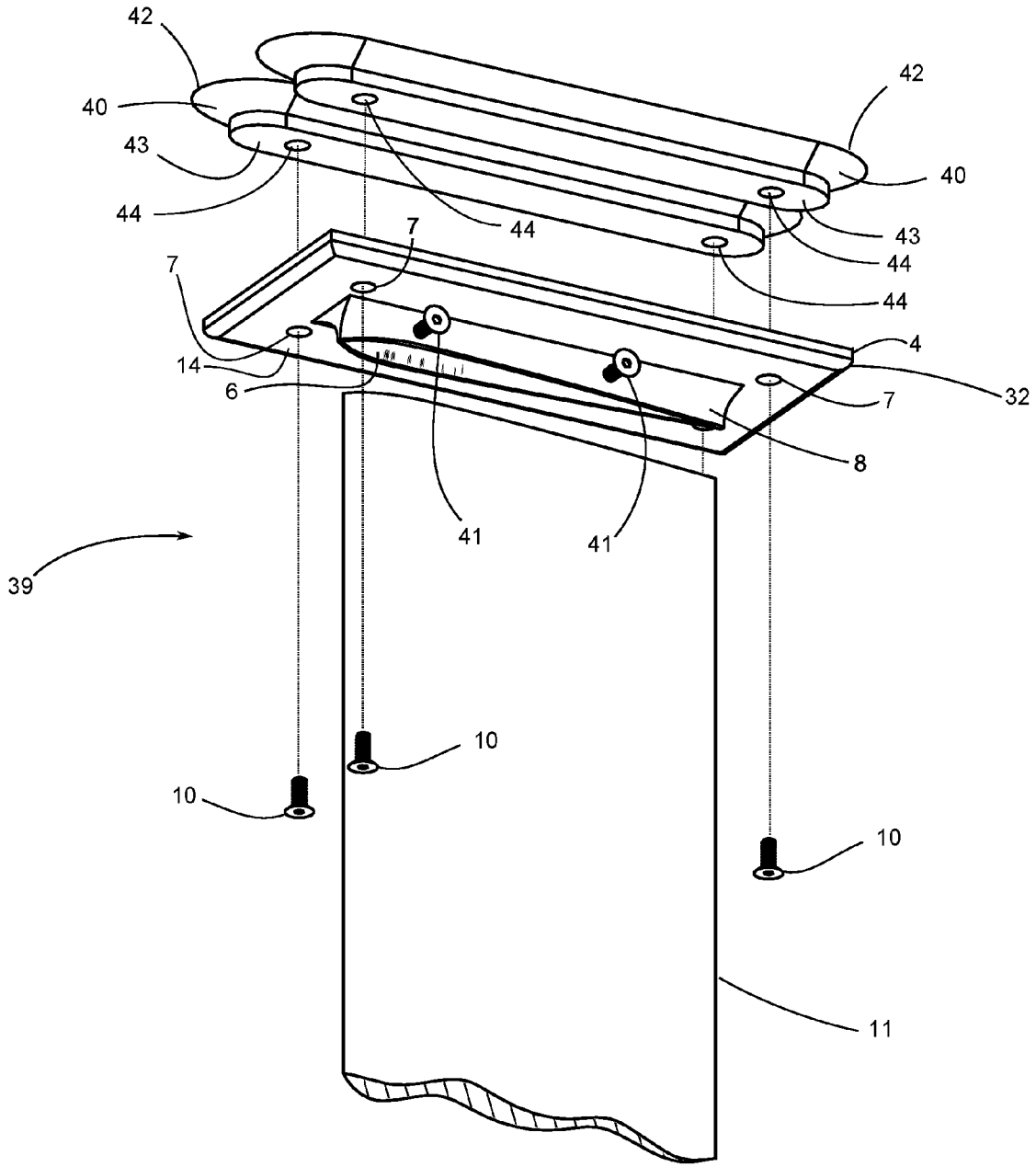
FIG. 10 is a perspective view of an alternative embodiment where the distributor member is attached to two elongated suction cups and the fin member is attached with side mount screws.

A different embodiment of the fin assembly 39 is illustrated in FIG. 10 in an exploded perspective view. This embodiment shares many features of the preferred embodiment with the primary differences being that two elongated suction cups 40 are used in place of the four suction cups 1 of FIG. 1, and side mount screws 41 are used to attach the fin member 11 to the distributor member 4 in place of screws 5 of FIG. 1. In this embodiment the fin member 11 is held in place by friction and compression with the side mount screws 41 which can be tightened against the port side 17 of the fin member 11 once the fin member 11 has been inserted into the recess 6. The elongated suction cups 40 have a cup side 42 and an anti-cup side 43. The elongated suction cups 40 have tapped holes 44 for attachment with screws 10. It will be understood by those of ordinary skill in the art that other standard attachment means could be used in place of the screwed attachments illustrated.

Figure 11:
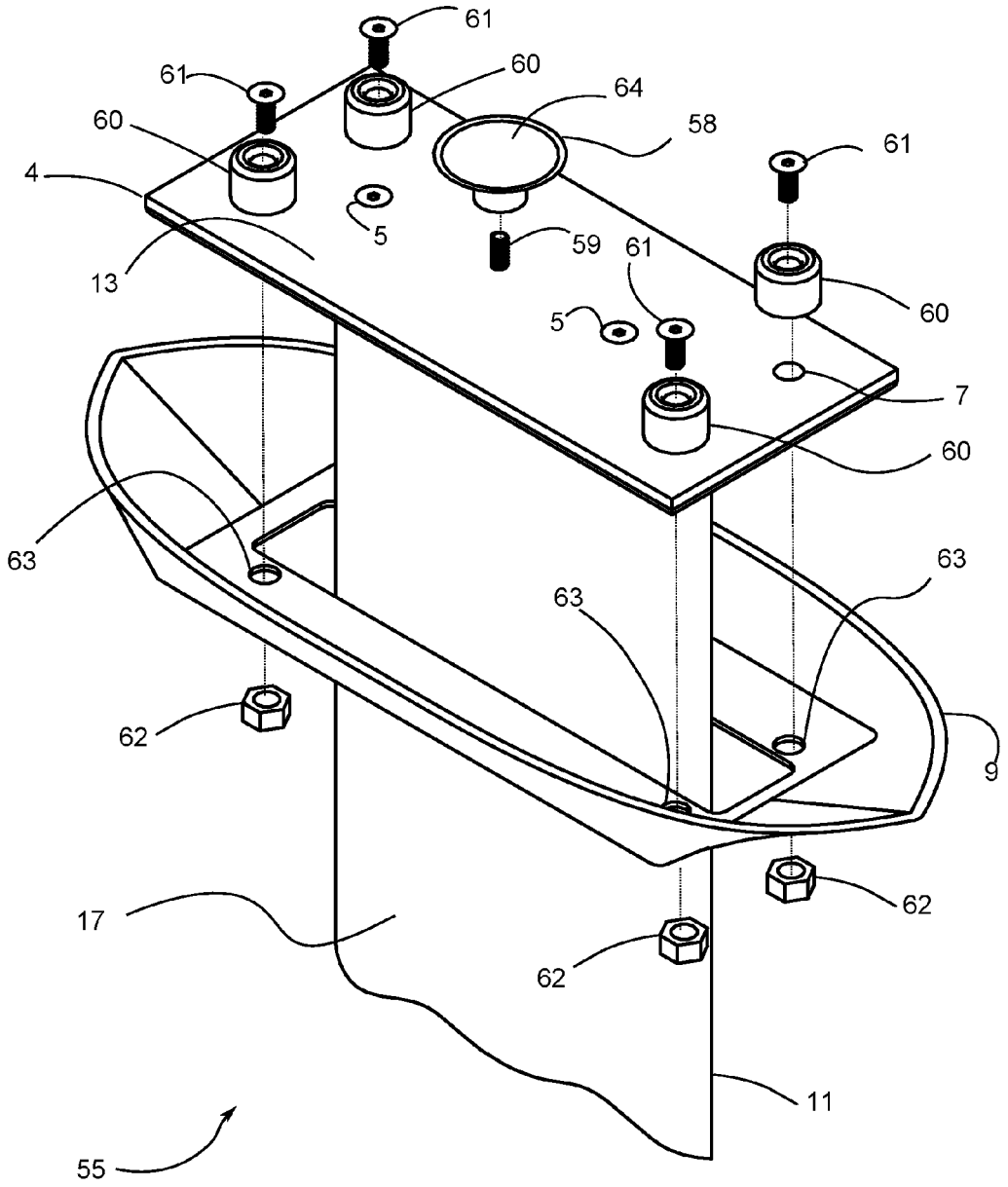
FIG. 11 is a perspective view of an alternative embodiment-here a single suction cup is used in conjunction with elastomeric bumpers.

A different embodiment of the fin assembly 55 is illustrated in FIG. 11 in an exploded top oriented perspective view. This embodiment shares many features of the preferred embodiment such as the fin member 11, screws 5, distributor member 4, shell 9, and untapped holes 7. In this embodiment, a single suction cup 58 is attached to the center of the suction side 13 of the distributor member 4 with a threaded element 59. The threaded element 59 is non-removably attached to the distributor member 4 in this embodiment such as by welding. Elastomeric bumpers 60 are attached to the suction side 13 of the distributor member 4 with screws 61. Screws 61 extend through holes 7 and holes 63 and are attached to nuts 62. The port side 17 of the fin member 11 is visible. The cup side 64 of the suction cup 58 is facing up. It will be understood by those of ordinary skill in the art that other standard attachment means could be used in place of the screwed and nutted and welded attachments illustrated.

Figure 12:
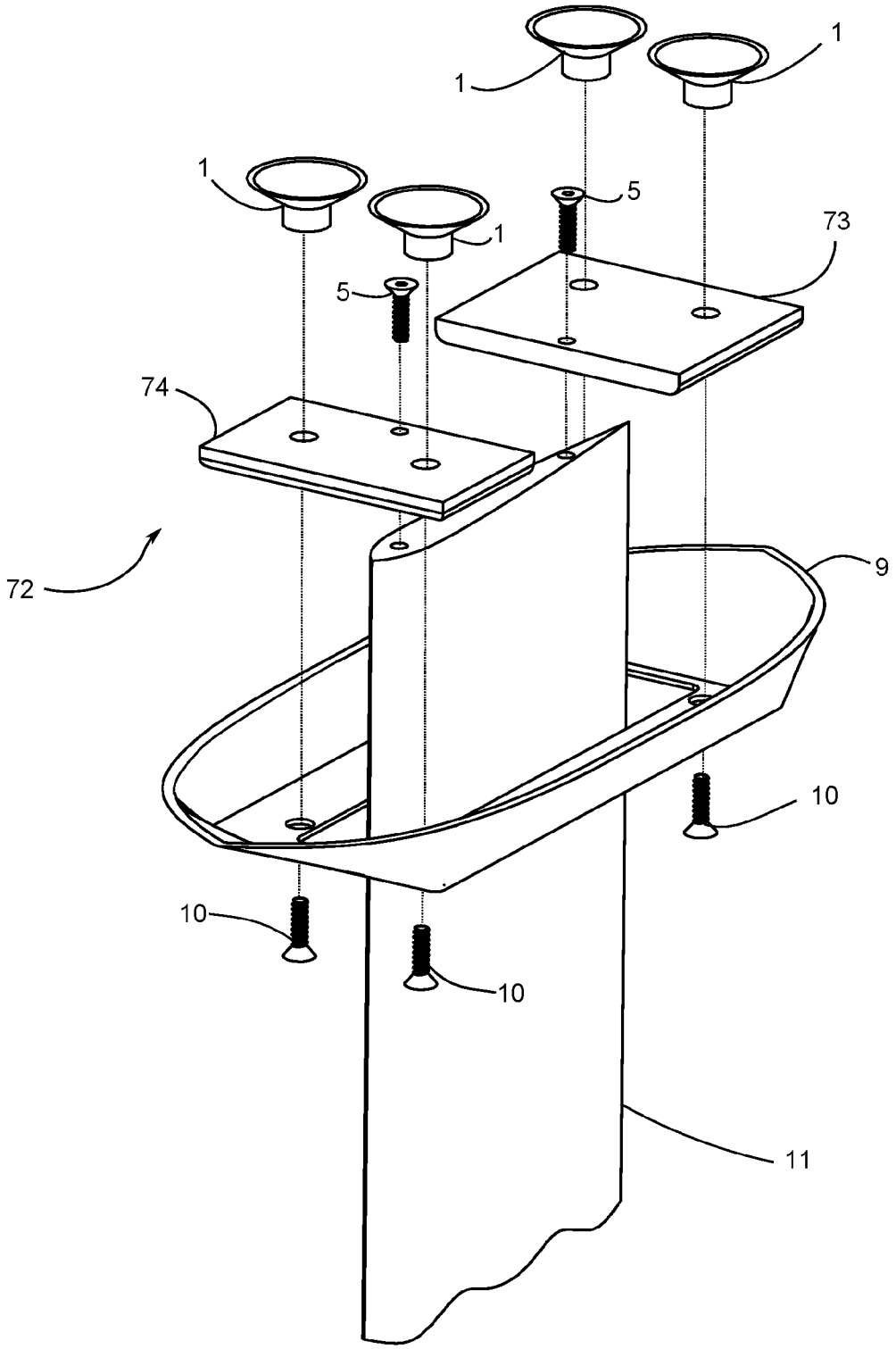
FIG. 12 is an exploded perspective view of an alternative embodiment where more than one distributor members are used.

Another alternative embodiment of the fin assembly 72 is depicted in FIG. 12. This embodiment shares many features of the preferred embodiment such as the fin member 11, screws 5, shell 9, screws 10, and suction cups 1. The primary difference is that the fin member 11 in this embodiment is attached to more than one distributor member. The forward distributor member 74 and the rear distributor member 73 each being attached to a pair of suction cups 1.

What is claimed is:

1. A removable fin assembly for mounting to the underside of a small watercraft having a centerline comprising:

at least one suction cup having a cup side and an anti-cup side wherein the cup side can be reversibly attached to the underside of said small watercraft;

at least one distributor member having a fin side and a suction side wherein the suction side of at least one distributor member is attached to the anti-cup side of at least one suction cup; and at least 1 fin member having a port side and a starboard side along a transverse axis wherein at least one fin member is attached to the fin side of at least one distributor member and mounted such that the transverse axis of said fin member is not parallel to the centerline of said small watercraft and said fin member extends downwardly with respect to said small watercraft.

2. The removable fin assembly of claim 1, further comprising at least one suction cup which is elongated.

3. The removable fin assembly of claim 1, further comprising at least one suction cup attached to at least one distributor member with at least one adjustable connection.

4. The removable fin assembly of claim 1, further comprising at least one suction cup having an interior wall and an exterior wall and a vent hole which leads from the exterior wall to the interior wall of said vented suction cup and at least one backflow prevention device mounted such that fluid can flow through the vent port of said suction cup from the interior wall side to the exterior wall side of said vented suction cup but fluid flow is limited in the reverse direction.

5. The removable fin assembly of claim 1, further comprising at least one suction cup which is lever activated.

6. The removable fin assembly of claim 1, further comprising at least one fin member reversibly attached to at least one distributor member.

7. The removable fin assembly of claim 1, wherein at least one distributor member further comprises at least one rounded or chamfered edge.

8. The removable fin assembly of claim 1, further comprising a shell attached to at least one distributor member having walls bending upwardly from the perimeter of said distributor member and terminating as closely as possible to the underside of said small watercraft.

9. The removable fin assembly of claim 1, further comprising at least one fin member which is a hydrofoil keel.

10. The removable fin assembly of claim 1, further comprising at least one suction cup removably attached to at least one distributor member.

11. The removable fin assembly of claim 1, wherein said fin assembly is positively buoyant in water.

12. The removable fin assembly of claim 1, further comprising at least one recess.

13. The removable fin assembly of claim 1, further comprising at least one elastomeric bumper.

14. A method for attaching a removable fin assembly to the underside of a small watercraft having a centerline comprising:

(a) providing a fin assembly comprising
at least one suction cup,
at least one distributor member, and
at least one fin member having a transverse axis;

(b) locating the desired attachment location on the underside of said small watercraft;

(c) orienting the fin assembly such that the transverse axis of said fin member is not parallel to the centerline of said small watercraft and such that the fin member extends downwardly with respect to said small watercraft; and, (d) temporarily attaching the fin assembly to the underside of said small watercraft at said desired attachment location with the suction force from at least one suction cup.

15. The method of claim 14, further comprising removing the fin assembly from said small watercraft.

* * * * *